US008281438B2

(12) United States Patent
Bae et al.

(10) Patent No.: US 8,281,438 B2
(45) Date of Patent: Oct. 9, 2012

(54) WASHING MACHINE AND METHOD OF CONTROLLING A WASHING MACHINE

(75) Inventors: Sun Cheol Bae, Changwon-si (KR); Kyung Hoon Kim, Changwon-si (KR); Han Su Jung, Changwon-si (KR); Jae Hyeok Choi, Changwon-si (KR); Ja In Koo, Changwon-si (KR)

(73) Assignee: LG Electronics Inc., Seoul (KR)

( * ) Notice: Subject to any disclaimer, the term of this patent is extended or adjusted under 35 U.S.C. 154(b) by 638 days.

(21) Appl. No.: 12/466,526

(22) Filed: May 15, 2009

(65) Prior Publication Data

US 2010/0031451 A1 Feb. 11, 2010

(30) Foreign Application Priority Data

May 26, 2008 (KR) ..... 10-2008-0048784

(51) Int. Cl.
*D06F 35/00* (2006.01)

(52) U.S. Cl. ..... 8/158; 68/12.04

(58) Field of Classification Search ..... 68/12.02, 68/12.04; 8/158, 159
See application file for complete search history.

(56) References Cited

U.S. PATENT DOCUMENTS

| | | | |
|---|---|---|---|
| 2001/0011395 | A1 | 8/2001 | Skripper |
| 2006/0207299 | A1 | 9/2006 | Okasaki et al. |

FOREIGN PATENT DOCUMENTS

| | | |
|---|---|---|
| CN | 1756867 | 4/2006 |
| KR | 1996-0014492 | 5/1996 |
| KR | 10-2000-0000863 | 1/2000 |
| KR | 10-2004-0046077 | 6/2004 |

OTHER PUBLICATIONS

Chinese Office Action dated Jul. 29, 2010 and English translation.
Australian Office Action dated May 14, 2010.

*Primary Examiner* — Michael Barr
*Assistant Examiner* — David Cormier
(74) *Attorney, Agent, or Firm* — KED & Associates, LLP

(57) ABSTRACT

A washing machine and a method of controlling a washing machine are provided. A drum may be rotated from a stopped state to a specific angle less than 180 degrees. While the drum is rotated, a laundry amount may be sensed based on a current value of a motor that rotates the drum. The laundry amount may be sensed simply and accurately.

12 Claims, 6 Drawing Sheets

WASHING MACHINE AND METHOD OF CONTROLLING A WASHING MACHINE

This application claims priority from Korean Patent Application No. 10-2008-0048784, filed May 26, 2008, the subject matter of which is incorporated herein by reference.

BACKGROUND

1. Field

Embodiments of the present invention may relate to a washing machine and a method of controlling a washing machine. More particularly, embodiments of the present invention may relate to a washing machine that can sense a laundry amount simply and accurately.

2. Background

A drum-type washing machine may perform washing by employing a drum that rotates by a driving force of a motor and frictional force of laundry in a state in which a detergent, wash water, and the laundry are input to the drum. The drum-type washing machine may rarely damage the laundry, may rarely entangle the laundry, and may have knocking and rubbing washing effects.

After wash and rinse cycles are finished, a dehydration cycle may be performed. In order to perform the dehydration cycle, a laundry amount may be sensed. A variety of parameters, such as a characteristic speed value, a rotation angle at a specific speed, time taken to rotate at a specific speed, and a duty pulse width modulated (PWM) value at a specific speed may be used. However, this may be problematic in that it involves parameters and has to experience a significantly complicated process, such as changing different settings or control of pertinent parameters as conditions for a motor, a dehydration pattern, etc.

BRIEF DESCRIPTION OF THE DRAWINGS

Objects and features of arrangements and embodiments of the present invention may become apparent from the following description taken in conjunction with the accompanying drawings, in which like reference numerals refer to like elements and wherein.

DETAILED DESCRIPTION

Figure 1:
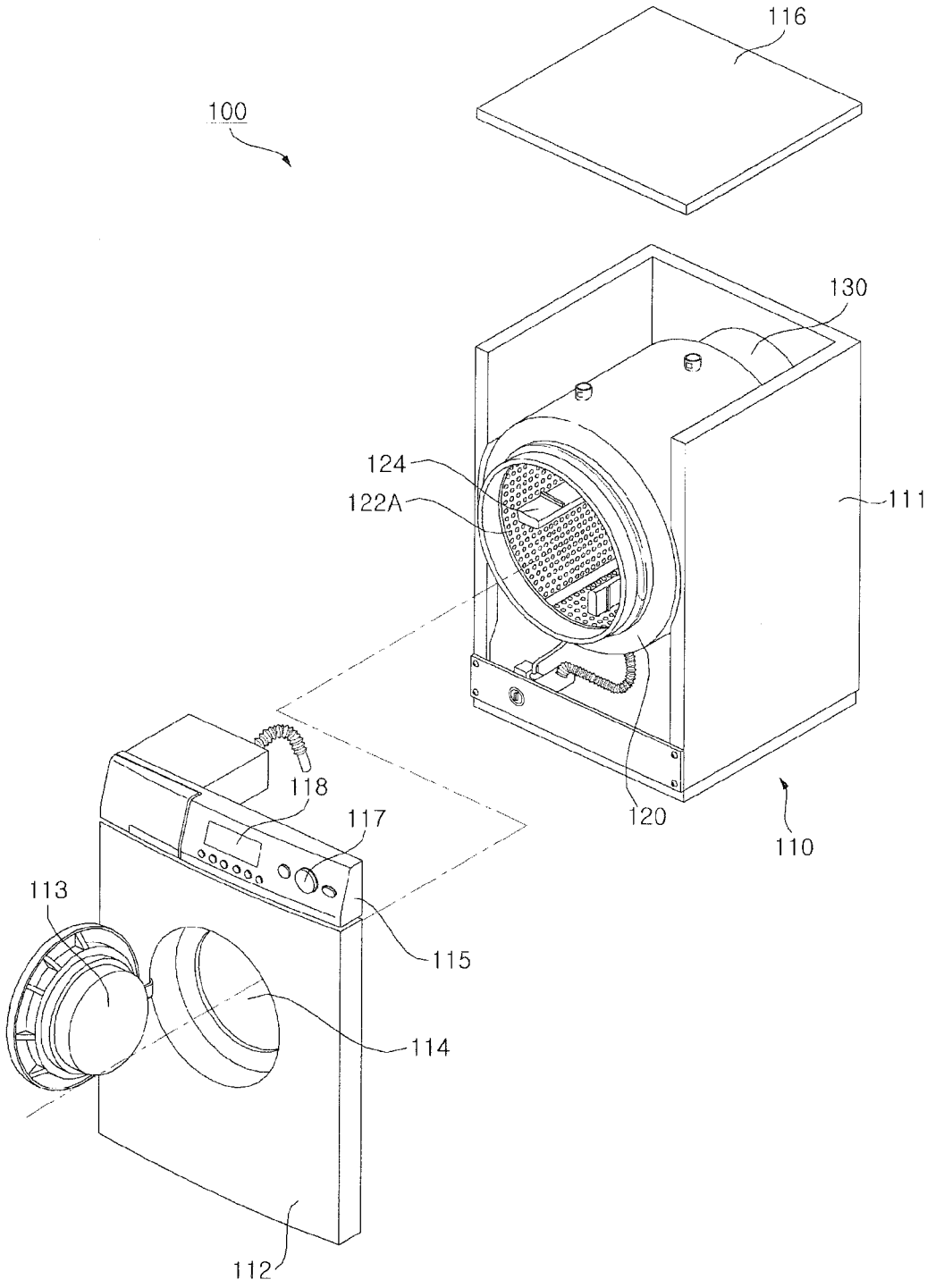
FIG. 1 is a perspective view showing a washing machine in accordance with an example embodiment of the present invention.

Arrangements and embodiments of the present invention may be described in detail with reference to the accompanying drawings FIG. 1 is a perspective view showing a washing machine in accordance with an example embodiment of the present invention. Other embodiments and configurations are also with the scope of the present invention.

More specifically, FIG. 1 shows a washing machine 100 that includes a cabinet 110 forming an external shape of the washing machine 100, a tub 120 disposed within the cabinet 110 and supported by the cabinet 110, a drum 122 disposed within the tub 120 in which laundry is washed, a motor 130 for driving the drum 122, a wash water supply apparatus (not shown) disposed outside a cabinet main body 111 and configured to supply wash water to the cabinet 110, and a drain apparatus (not shown) formed under the tub 120 and configured to drain wash water to outside.

The drum 122 may include a plurality of through-holes 122A for having wash water pass therethrough. Lifters 124 may be disposed within the drum 122 so that laundry may be raised up to a specific height when the drum 122 is rotated and may then be dropped because of gravity.

The cabinet 110 may include the cabinet main body 111, a cabinet cover 112 disposed on a front side of the cabinet main body 111 and coupled thereto, a control panel 115 disposed on an upper side of the cabinet cover 112 and coupled to the cabinet main body 111, and a top plate 116 disposed at the top of the control panel 115 and coupled to the cabinet main body 111.

The cabinet cover 112 may include a laundry inlet/outlet hole 114 formed to have laundry pass therethrough, and a door 113 disposed rotatably left and right so that the laundry inlet/outlet hole 114 may be opened and closed.

The control panel 115 may include a control button 117 for manipulating operating states of the washing machine 100, and a display device 118 disposed on one side of the control button 117 and configured to display operating states of the washing machine 100.

The control button 117 and the display device 118 within the control panel 115 may be electrically connected to a controller (not shown). The controller (not shown) may electrically control respective constituent elements, etc. of the washing machine 100. Operation of the controller (not shown) will be described below.

Figure 2:
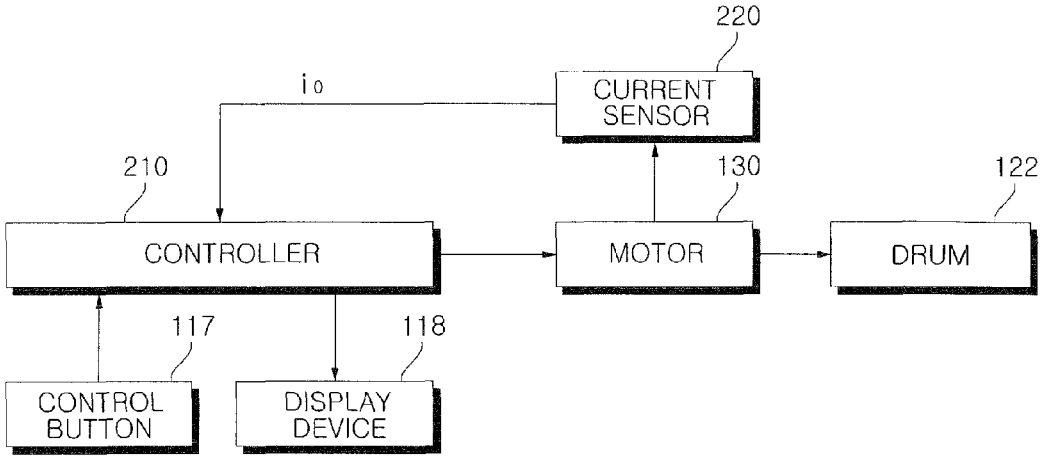
FIG. 2 is an internal block diagram of the washing machine shown in FIG. 1.

FIG. 2 is an internal block diagram of the washing machine shown in FIG. 1. Other embodiments and configurations are also within the scope of the present invention.

FIG. 2 shows a controller 210 that may operate in response to an operation signal received from the control button 117. Actual washing, rinse, and dehydration cycles may be performed. For the actual washing, rinse, and dehydration cycles, the controller 210 may control the motor 130. Although not shown, an inverter (not shown) may be used to control the motor 130. For example, when the controller 210 outputs a pulse width modulated (PWM) switching control signal (signal 'Sic' in FIG. 3) to the inverter (not shown), the inverter (not shown) may perform a high-speed switching operation in order to supply an AC power of a specific frequency to the motor 130.

The controller 210 may display operating states of the washing machine 100 through the display device 118. For example, the controller 210 may display operating states, such as actual washing, rinse, and dehydration cycles, through the display device 118.

The motor 130 may drive the drum 122. The drum 122 may be disposed within the tub 120, as shown in FIG. 1, and may allow for laundry to be input for washing. The drum 122 is driven by rotation of the motor 130.

The controller 210 may sense or determine the laundry amount based on current $i_o$ sensed by a current sensor 220.

More specifically, while the drum 122 is rotated up from a stopped position to a specific angle (or specific position) less than 180 degrees, the controller 210 may sense or determine the laundry amount based on the current $i_o$ of the motor 130. The specific angle may be 90 degrees, for example. The laundry amount may be sensed based on the current $i_o$ of the motor 130 as will be is described below.

The current sensor 220 may sense current (i.e., an output current $i_o$) flowing through the motor 130. The current sensor 220 may be a hall sensor, an encoder, etc. The current sensor 220 may periodically sense the current $i_o$ flowing through the motor 130 and provide a sensed current value to the controller 210. Meanwhile, the current sensor 220 may be included in the controller 210.

Although not shown, the washing machine may further include an unbalance amount sensor for sensing an unbalance amount of the drum 122 (i.e., unbalance (UB) of the drum 122). The unbalance amount sensor may sense an unbalance amount of the drum 122 based on variation in a rotational speed of the drum 122 (i.e., variation in rotational speed of the motor 130). A speed sensor (not shown) may also sense rotational speed of the motor 130. Alternatively, the rotational speed may be calculated based on the output current $i_o$ of the motor 130 sensed by the current sensor 220, and the unbalance amount may be sensed based on the calculated rotational speed. The unbalance amount sensor may be included in the controller 210.

Figure 3:
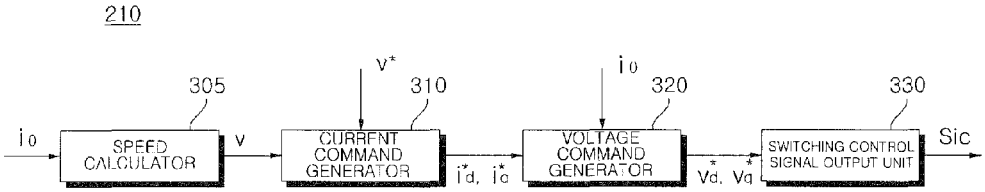
FIG. 3 is an internal block diagram of the controller shown in FIG. 2.

FIG. 3 is an internal block diagram of the controller shown in FIG. 2. Other embodiments and configurations are also within the scope of the present invention.

More specifically, the controller 210 may include a speed calculator 305, a current command generator 310, a voltage command generator 320, and a switching control signal output unit 330.

The speed calculator 305 may calculate a rotator speed v of the motor 130 based on a detected output current $i_o$. The speed calculator 305 may also calculate a position of the rotator in addition to the speed of the rotator.

The current command generator 310 may generate current command values $i^*_d$, $i^*_q$ based on the calculated speed v and a speed command value v*. The current command generator 310 may include a PI controller (not shown) for generating the current command values $i^*_d$, $i^*_q$ based on an estimated speed v and the speed command value v* and a current command limiter (not shown) to limit a level of each of the current command values $i^*_d$, $i^*_q$ such that they do not exceed a specific value.

The voltage command generator 320 may generate voltage command values $v^*_d$, $v^*_q$ based on the current command values $i^*_d$, $i^*_q$ and a detected current $i_o$. The voltage command generator 320 may include a PI controller (not shown) for generating the voltage command values $v^*_d$, $v^*_q$ based on the current command values $i^*_d$, $i^*_q$ and the detected current $i_o$ and a voltage command limiter (not shown) to limit a level of each of the voltage command values $v^*_d$, $v^*_q$ such that they do not exceed a specific value.

The switching control signal output unit 330 may generate a switching control signal Sic (i.e., a PWM signal) for an inverter based on the voltage command values $v^*_d$, $v^*_q$ and output the generated signal to an inverter (not shown).

The motor 130 may operate according to the speed command value v* in response to the switching control signal Sic for the inverter. While the motor 130 may rotate up to a specific angle or specific position, the speed command value v* may be, for example, 50 rpm so as to sense a laundry amount based on the current value of the motor 130.

The current value of the motor 130 may be the output current $i_o$ of the motor 130 sensed by the current sensor 220. For example, the current value of the motor 130 may be the current command values $i^*_d$, $i^*_q$. The output current $i_o$ of the motor 130 may flow while keeping track of the current command values $i^*_d$, $i^*_q$, and therefore may sense the laundry amount based on the current command values $i^*_d$, $i^*_q$.

Figure 4:
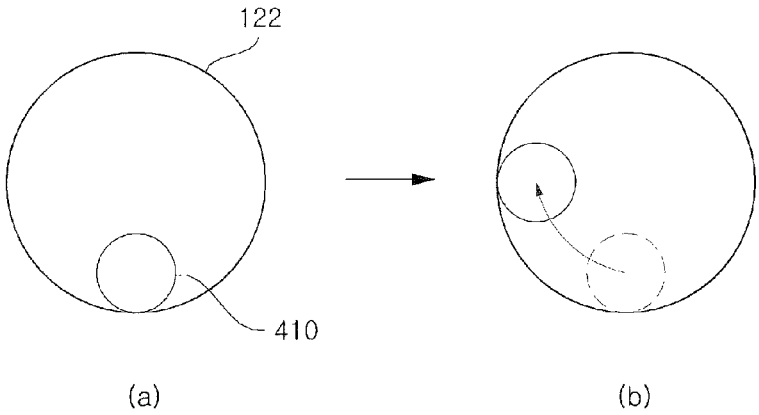
FIGS. 4(*a*)-4(*b*) are diagrams showing operations of a drum within the washing machine shown in FIG. 1.

FIGS. 4(*a*)-4(*b*) are diagrams showing operations of a drum within the washing machine shown in FIG. 1. Other diagrams and embodiments are also within the scope of the present invention.

FIG. 4(*a*) shows the drum 122 in a stopped state (or stopped position). That is, FIG. 4(*a*) shows a specific laundry 410 disposed at a bottom of the drum 122. FIG. 4(*b*) shows the laundry 410 adhering to a left side of the drum 122 while the drum 122 is rotated clockwise to a specific angle (i.e., 90 degrees in FIG. 4(*b*)).

The controller 210 may sense the laundry amount based on a current value of the motor 130 while the drum 122 is rotated from a stopped state to a specific angle.

The rotational speed of the motor 130 may be a speed at which the laundry 410 adheres to the drum 122. The speed may be approximately 50 rpm, for example.

Figure 5:
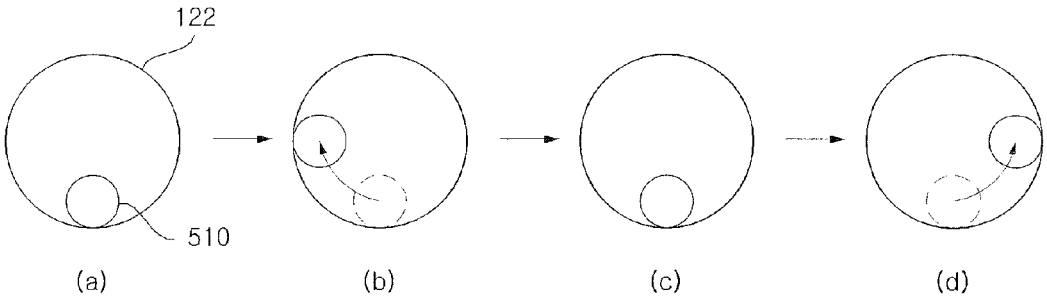
FIGS. 5(*a*)-5(*d*) are diagrams showing operations of a drum within the washing machine shown in FIG. 1.

FIGS. 5(*a*)-5(*d*) are diagrams showing operations of the drum within the washing machine shown in FIG. 1. Other diagrams and embodiments are also within the scope of the present invention.

FIG. 5 is similar to FIG. 4 except for the patterns in which the drum 122 is rotated. FIG. 5(*a*) shows the drum 122 in the stopped state (or stopped position) such as in FIG. 4(*a*). FIG. 5(*b*) shows a state where the drum 122 is rotated clockwise to a specific angle (i.e., 90 degrees in FIG. 5(*b*)) or specific position. FIG. 5(*c*) shows the drum 122 again in the stopped state (or stopped position). FIG. 5(*d*) shows a state where the drum 122 is rotated counterclockwise to a specific angle (i.e., 90 degrees) or specific position. The operations of stopping, rotating in a first direction, stopping, and rotating in a second direction opposite to the first direction may be repeated, and the controller 210 may sense a laundry amount based on a current value of the motor 130 (while the drum 122 is being rotated).

Figure 6:
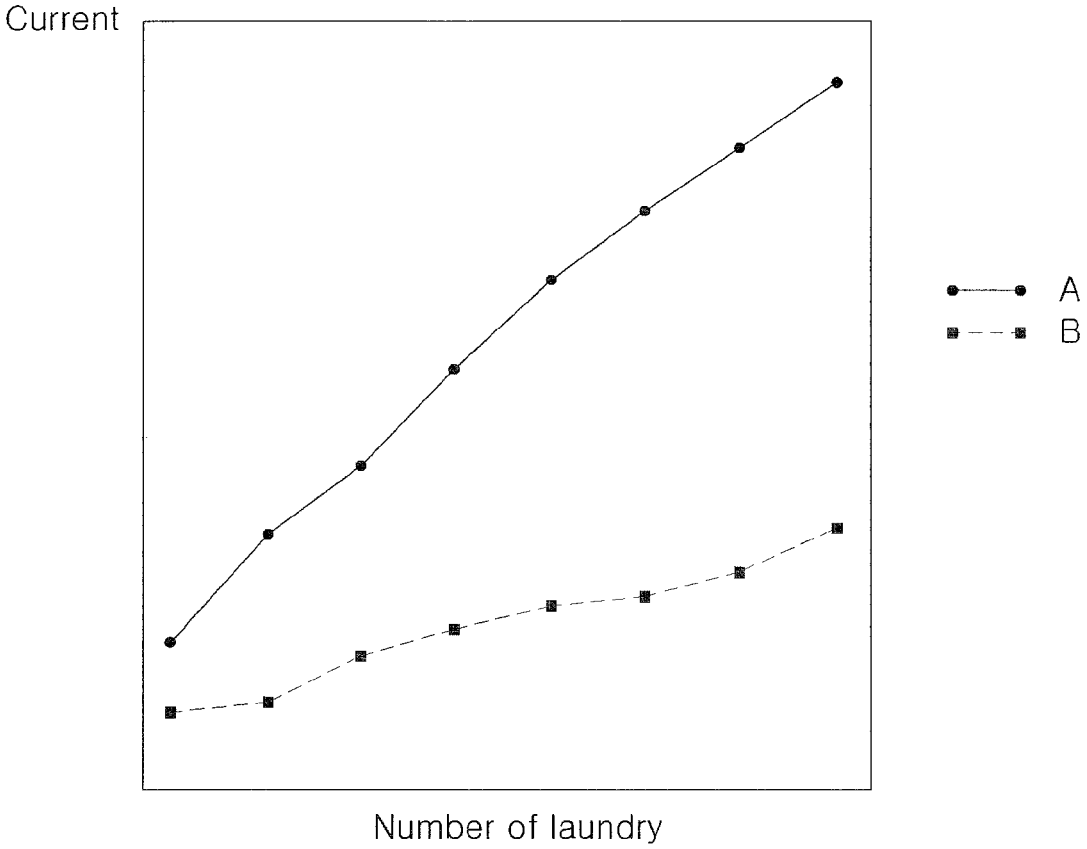
FIG. 6 is a graph showing a relationship between a number of laundry and current.

FIG. 6 is a graph showing a relationship between a number of laundry and current. Other graphs and embodiments are also within the scope of the present invention.

FIG. 6 shows that as a number of laundry increases, the current value of the motor 130 increases. In FIG. 6, 'A' represents an example where the rotational speed of the drum 122 is a first speed, and 'B' represents an example where the rotational speed of the drum 122 is a second speed slower than the first speed.

As may be seen from FIG. 6, the laundry amount increases as a number of laundry increases. The laundry amount and a current value may have a proportional relationship. The laundry amount may be sensed by employing this relationship.

The relationship where the laundry amount is sensed based on the current value of the motor 130, described above with reference to FIGS. 2 to 5, may sense the laundry amount in proportion to the current of the motor 130. Corresponding current values of the motor 130 may be added together (or summed) while the drum 122 is rotated up to a specific angle, and the laundry amount may be sensed or determined based on the added (or summed) value. This rotation angle may be set to 90 degrees, for example, in consideration of gravity and frictional force within the drum 122. However, embodiments of the present invention are not limited to this example. For example, when a specific angle is set to 90 degrees or more, the laundry amount may be sensed based on only a current value corresponding to 90 degrees of the drum 122. The specific angle may be set to 180 degrees or greater.

As the specific pattern of stopping and rotating is repeated as shown in FIGS. 4 and 5, a variety of methods may be possible such as a method of adding current values of the motor 130 and sensing the laundry amount based on an average value of the added current values.

Figure 7:
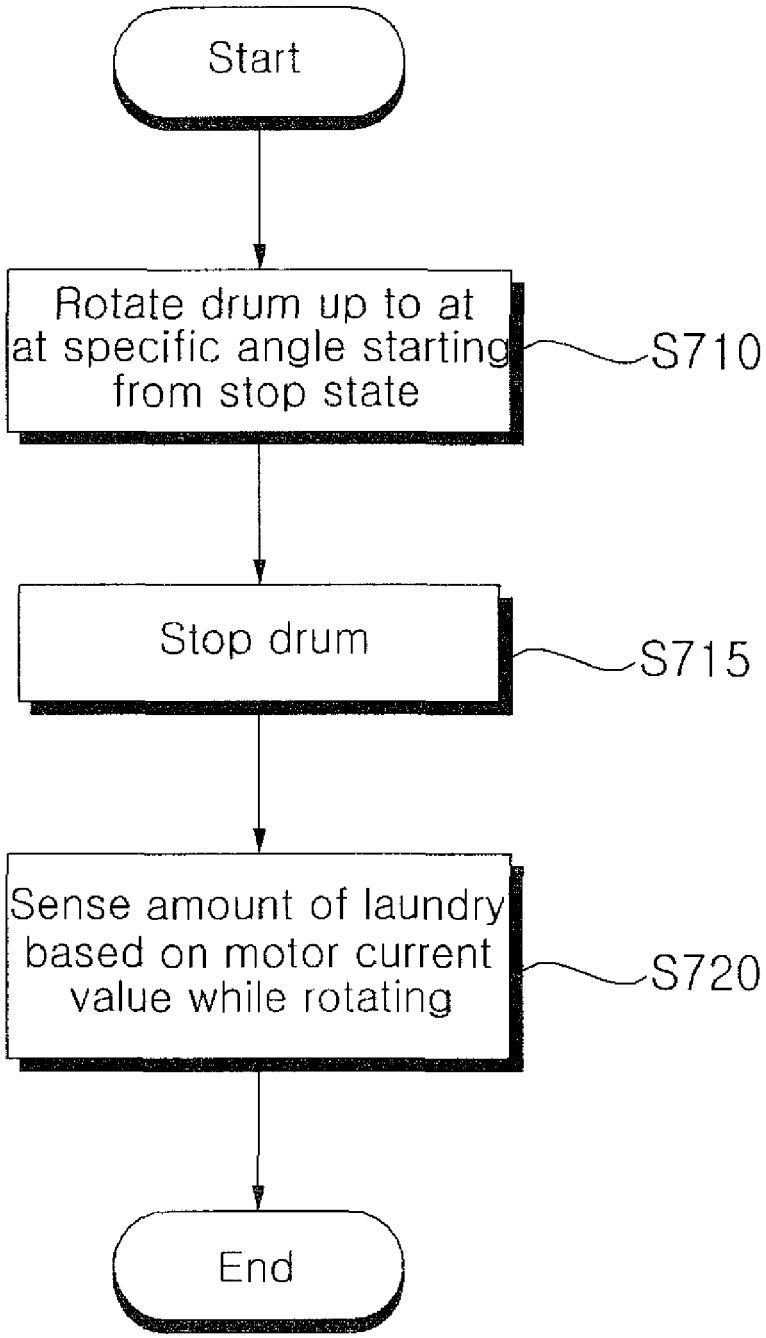
FIG. 7 is a flowchart illustrating a method of controlling a washing machine in accordance with an example embodiment of the present invention.

FIG. 7 is a flowchart illustrating a method of controlling a washing machine in accordance with an example embodiment of the present invention. Other operations, orders of operations and configurations are also within the scope of the present invention.

The drum 122 may be rotated from a stopped state (or stopped position) to a specific angle in operation S710. For example, the drum 122 may be rotated clockwise 90 degrees, as shown in FIG. 5(*b*), starting from the stopped position of FIG. 5(*a*). The rotational speed of the drum 122 may be a speed at which laundry adheres to the drum 122.

The rotation of the drum 122 may stop in operation S715. For example, rotation of the drum 122 may stop as shown in FIG. 5(*c*).

While the drum 122 is rotated, the controller 210 may sense the amount of the laundry based on the current value of the motor 130 in operation S720. While the drum 122 is rotated, the current sensor 220 may sense the current value of the motor 130, and the controller 210 may receive the sensed current value and sense the laundry amount based on the received current value. In other words, the controller 210 may add the sensed current values, calculate an average value of the added current values, and calculate the amount of the laundry.

On the other hand, while the rotation operation S710 and the stop operation S715 are repeated, the controller 210 may sense the amount of the laundry based on a sensed current value.

Figure 8:
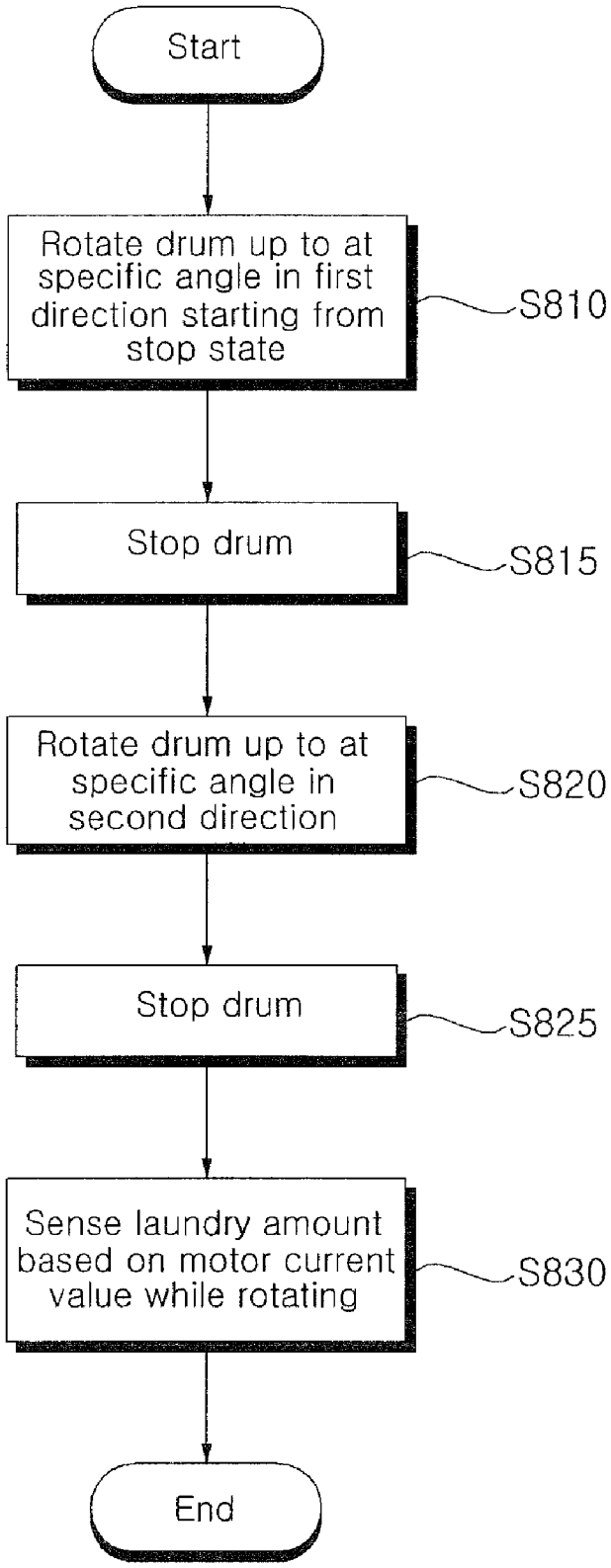
FIG. 8 is a flowchart illustrating a method of controlling a washing machine in accordance with an example embodiment of the present invention.

FIG. 8 is a flowchart illustrating a method of controlling a washing machine in accordance with an example embodiment of the present invention. Other operations, orders of operations and configurations are also within the scope of the present invention.

As shown in FIG. 8, the drum 122 may rotate in a first direction from a stopped position (or state) to a specific angle in operation S810. For example, the drum 122 may rotate clockwise 90 degrees as shown in FIG. 5(*b*), starting from the stop state or stopped position of FIG. 5(*a*). The rotational speed of the drum 122 may be a speed at which laundry adheres to the drum 122.

Rotation of the drum 122 may then stop in operation S815. For example, the rotation of the drum 122 may stop as shown in FIG. 5(*c*).

The drum 122 may then rotate in a second direction from the stopped position (or state) up to a specific angle in operation S820. For example, the drum 122 may rotate counterclockwise from the stopped state of FIG. 5(*c*) to an angle of 90 degrees as shown in FIG. 5(*d*). The second direction may be opposite the first direction. The rotational speed of the drum 122 may be a speed at which laundry adheres to the drum 122.

Rotation of the drum 122 may stop in operation S825. For example, the rotation of the drum 122 may stop as shown in FIG. 5(*a*).

While the drum 122 is rotated, the controller 210 may sense the amount of the laundry based on the current value of the motor 130 in operation S830. This rotation of the drum 122 may correspond to the rotation operation S810 in the first direction and the rotation operation S820 in the second direction. The current sensor 220 may sense the current value of the motor 130, and the controller 210 may receive the sensed current value and determine the amount of the laundry based on the received current value. While the drum 122 is rotated in the second direction opposite the first direction, the current value may be sensed so that the laundry amount may be determined more accurately.

While the rotation operation S810 in the first direction, the stop operation S815, the rotation operation S820 in the second direction, and the stop operation S825 are repeatedly performed, the laundry amount may be sensed based on a current value.

Embodiments of the present invention may provide a washing machine and method that may sense a laundry amount simply and accurately.

An embodiment of the present invention may provide a method of controlling a washing machine that includes a drum that is rotated. The method may include rotating the drum up to at a specific angle less than 180 degrees, starting from a stop state. While the drum is rotated, an amount of the laundry may be sensed based on a current value of a motor that rotates the drum.

An embodiment of the present invention may provide a washing machine that includes a drum rotated by a motor. The drum may have laundry entered therein and rotated. A current sensor may sense current flowing through the motor. A controller may control the drum to rotate up to a specific angle less than 180 degrees starting from a stop state, and the controller may determine (or sense) an amount of the laundry based on the sensed current while the drum is rotated.

The method of controlling the washing machine in accordance with example embodiments of the present invention may be implemented as a processor-readable code in a recording medium, which can be read by a processor equipped in a washing machine. The processor-readable recording medium can include all kinds of recording devices in which data readable by a processor is stored. For example, the processor-readable recording medium can include ROM, RAM, CD-ROM, magnetic tapes, floppy disks, optical data storages, and so on, and can also be implemented in the form of carrier waves, such as transmission over the Internet. Further, the processor-readable recording medium can be distributed into computer systems connected over a network, so codes readable by a processor can be stored and executed in a distributed manner.

As described above, the laundry amount may be sensed simply, accurately, and independently based on a current value of the motor.

At a time of the dehydration cycle, stability of a washing machine and laundry balancing may be improved based on the sensed laundry amount.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of controlling a washing machine that includes a horizontal drum, the method comprising:

rotating the drum from a stopped state to at a specific angle that is more than approximately 90 degrees rotation from the stopped state, the stopped state being a stopped position; and while the drum is rotating from the stopped state to at the specific angle, sensing an amount of laundry based on a sum of current components of a motor, corresponding to a section in which the drum rotates from the stopped position to approximately 90 degrees rotation from the stopped position.

2. The method of claim 1, further comprising:

stopping the rotating of the drum;

rotating the drum again from a stopped state to at the specific angle that is more than 90 degrees rotation from the stopped state; and while the drum is rotating again from the stopped state to the specific angle, sensing an amount of laundry based on a sum of current components of the motor, corresponding to a section in which the drum again rotates from the stopped position to approximately 90 degrees rotation from the stopped position.

3. The method of claim 1, further comprising stopping the rotating of the drum, and rotating the drum in another direction, and wherein the sensing of the amount of the laundry is performed when the drum is rotating from the stopped state in the another direction.

4. The method of claim 1, wherein the current of the motor comprises an output current flowing through the motor.

5. The method of claim 1, wherein the current of the motor comprises a current command value for driving the motor.

6. The method of claim 1, wherein rotating the drum comprises rotating the drum at a speed at which the laundry adheres to the drum.

7. A method of controlling a washing machine that includes a horizontal drum, the method comprising:

rotating the drum from a stopped position to a first position that is more than approximately 90 degrees of rotation from the stopped position;

while the rotating of the drum is being performed, determining a first sum of current components of a motor when the drum is in a section from the stopped position to a second position that is approximately 90 degrees rotation from the stopped position; and determining an amount of laundry based on the determined first sum of current components.

8. The method of claim 7, further comprising:

stopping the rotating of the drum;

rotating the drum again from the stopped position to the first position;

while the rotating of the drum is again being performed, determining a second sum of components of the motor when the drum is in the section from the stopped position to the second position; and determining an amount of laundry based on the determined second sum of current components.

9. The method of claim 7, further comprising:

stopping the rotating of the drum, and rotating the drum in another direction, and wherein determining the first sum of current components is performed while the drum is rotated from the stopped position in the another direction.

10. The method of claim 7, wherein the current of the motor includes an output current flowing through the motor.

11. The method of claim 7, wherein the current of the motor includes a current command value for driving the motor.

12. The method of claim 7, wherein rotating the drum includes rotating the drum at a speed such that the laundry adheres to the drum.

* * * * *